US008437686B2

(12) United States Patent
Nakamichi

(10) Patent No.: US 8,437,686 B2
(45) Date of Patent: May 7, 2013

(54) IMAGE FORMING SYSTEM AND IMAGE FORMING APPARATUS

(75) Inventor: Motoki Nakamichi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 621 days.

(21) Appl. No.: 12/555,281

(22) Filed: Sep. 8, 2009

(65) Prior Publication Data

US 2010/0067967 A1 Mar. 18, 2010

(30) Foreign Application Priority Data

Sep. 16, 2008 (JP) ..... 2008-236773

(51) Int. Cl.
*G03G 15/00* (2006.01)

(52) U.S. Cl.
USPC ..... 399/406; 399/407

(58) Field of Classification Search ..... 399/406
See application file for complete search history.

(56) References Cited

U.S. PATENT DOCUMENTS

| | | | | |
|---|---|---|---|---|
| 5,237,379 | A * | 8/1993 | Sklut et al. | 399/86 |
| 5,414,503 | A * | 5/1995 | Siegel et al. | 399/406 |
| 6,259,888 | B1 * | 7/2001 | Kazama et al. | 399/406 |
| 6,687,484 | B2 * | 2/2004 | Oikawa | 399/406 |
| 7,383,017 | B2 * | 6/2008 | Ushio | 399/406 |
| 7,406,292 | B2 * | 7/2008 | Kamiyama | 399/406 |
| 7,809,323 | B2 * | 10/2010 | Johnston et al. | 399/406 |
| 8,145,118 | B2 * | 3/2012 | Seto | 399/406 |
| 2008/0159795 | A1 * | 7/2008 | Mori et al. | 399/406 |

FOREIGN PATENT DOCUMENTS

| | | |
|---|---|---|
| JP | 05-309971 | 11/1993 |
| JP | 2002-080157 | 3/2002 |
| JP | 2006-016157 | 1/2006 |
| JP | 2007-145491 | 6/2007 |

OTHER PUBLICATIONS

Japanese Office Action dated Jun. 29, 2010 and English translation thereof, issued in counterpart Japanese Application No. 2008-236773.

* cited by examiner

*Primary Examiner* — Anthony Nguyen
(74) *Attorney, Agent, or Firm* — Holtz, Holtz, Goodman & Chick, P.C.

(57) ABSTRACT

An image forming system includes: a decurl section which corrects a curl on a sheet on which an image has been formed; a sheet ejection section on which the sheet to be ejected is stacked; a finishing section which conducts post processing on the sheet on which the image has been formed and ejects the sheet on the sheet ejection section; and an operation and display section having a setting screen for setting a post-processing condition and a selection screen for selecting a decurl direction to be corrected by the decurl section. A selection section that selects the decurl direction given by the decurl section, and a decurl image that shows a decurl direction on the sheet ejection section for the sheet, are indicated on the selection screen, and the selection section and the decurl image are displayed on the same selection screen.

14 Claims, 11 Drawing Sheets

FIG. 2A
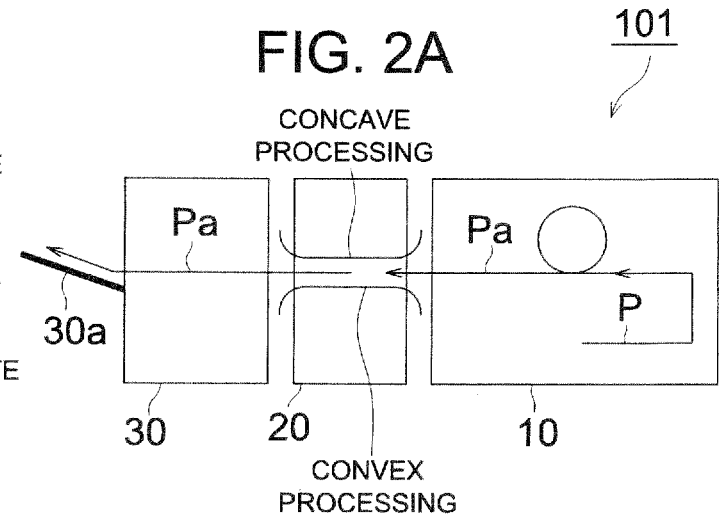
FIG. 2B
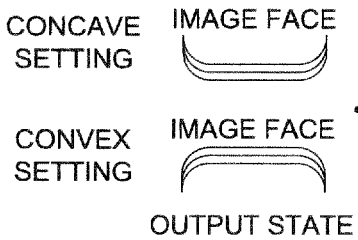
FIG. 2C
FIG. 3A
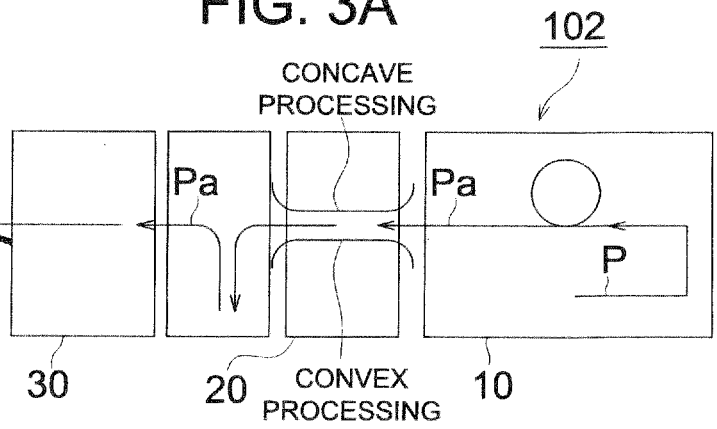
FIG. 3B
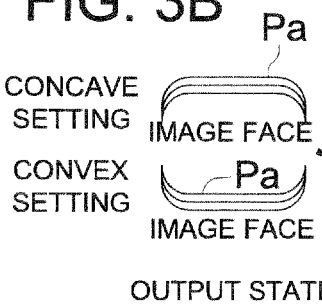
FIG. 3C FIG. 4B
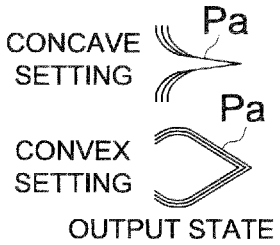
FIG. 4C
FIG. 4A
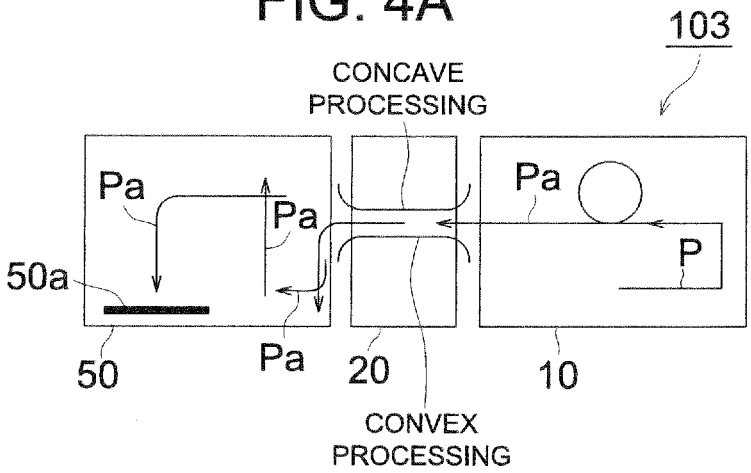

IMAGE FORMING SYSTEM AND IMAGE FORMING APPARATUS

This application is based on Japanese Patent Application No. 2008-236773 filed on Sep. 16, 2008, which is incorporated hereinto by reference.

BACKGROUND OF THE INVENTION

The invention relates to an image forming system including a printer for forming a color image or for forming a monochrome image having a decurl function to correct a curl on a sheet on which an image has been formed, a copying machine and a multifunction peripheral in which functions of the printer and the copying machine are compounded.

In recent years, a high-speed printer for forming monochrome images of an electrophotographic type and of a direct-transfer type, a copying machine, a multifunction peripheral having functions of the high-speed printer and the copying machine, a color printer of a tandem type, a color copying machine and a color copying machine having functions of the tandem type color printer and the color copying machine have come to be used widely. In these image forming apparatuses of an electrophotographic type, there are problems that a sheet is curled or transformed into a waviness shape, because the sheet loses moisture when it is in a fixing process.

As an image forming apparatus for solving the problems, Unexamined Japanese Patent Application Publication No. 05-309971 (FIG. 1) discloses an image forming apparatus having therein a decurl device, a sheet finisher and a controller, wherein curls of transfer material are removed by the decurl device. The sheet finisher carries out post-processing for the transfer material on which an image has been formed. The controller controls operation conditions such as pressing force of the decurl device for a sheet material, depending on a post-processing mode of the sheet finisher. Owing to the structure of this kind, efficient decurling (which will be also called decurl processing, hereafter) becomes to be possible, which improves a stackable property for sheet ejection.

Further, relating to an image forming apparatus that corrects curls of a sheet, Unexamined Japanese Patent Application Publication No. 2002-080157 (FIG. 1) discloses a curl correcting unit having therein an adjusting mechanism, a control device and a manual changing device, wherein, when correcting curls caused on a sheet on which images have been formed to deform them to be curved temporarily, the adjusting mechanism adjusts an amount of curls to be corrected. The control device controls an amount of curls to be corrected which has been adjusted by the adjusting mechanism to the setting condition that is prescribed in advance, depending on fixed parameter information such as a sheet type and image density. With the foregoing serving as an assumption, the manual changing device makes an amount of curls to be corrected adjusted by the adjusting mechanism to be changed manually. By constituting the apparatus in the aforesaid manner, it is possible to change manually, even when curl correction by automatic adjustment of an amount of curl correction is not carried out correctly, thus, proper curl correction can be realized in a simple and easy way.

In the meantime, there are following problems in an image forming system equipped with a post-processing unit equipped with decurl functions which correct curls on a sheet on which images have been formed.

In the image forming apparatus disclosed by Unexamined Japanese Patent Application Publication No. 05-309971, an operation condition such as a pressing force of a decurl device for a sheet material is controlled depending on a post-processing mode. In fact, full automation of optimum decurl setting is extremely difficult because sheet conditions, output conditions and image forming conditions affect intricately.

Further, in the case of a curl correction unit disclosed in Unexamined Japanese Patent Application Publication No. 2002-080157, a manual changing device is provided so that an amount of curl correction which has been adjusted automatically may be changed manually for the sheet having thereon images for which the decurl direction has been set. In general, the decurl direction is set for the conveyance direction for a sheet. However, the sheet is sometimes reversed or rotated depending on the selected post-processing conditions. It is therefore necessary to consider the conveyance path up to a sheet-ejection tray to which the sheet is ejected finally, for setting the desired decurl direction for the sheet. This makes it difficult to set the decurl direction easily.

SUMMARY OF THE INVENTION

An image forming system relating to one aspect has therein an image forming section that forms images on a sheet, a decurl section that corrects curls on the sheet on which the images have been formed, a sheet ejection section on which the aforesaid sheets to be ejected are stacked, a finishing section that conducts post processing on the aforesaid sheet on which images have been formed and ejects the sheet on the aforesaid sheet election section and an operation and display section having a setting screen that sets post-processing conditions and a selection screen that selects the decurl direction to be corrected by the aforesaid decurl section, and is characterized in that a selection section that selects the decurl direction given by the aforesaid decurl section, and a decurl image that shows the decurl direction on the sheet ejection section for the sheet are indicated on the aforesaid selection screen, and the selection section and the decurl image are indicated on the same selection screen.

An image forming apparatus relating to another aspect is one equipped with the following structures representing an image forming section that forms an image on a sheet and an operation and display section that indicates a selection screen for selecting the decurl direction to correct curls on the sheet on which images have been formed, wherein the aforesaid selection screen indicates the selection section that selects a decurl direction and the aforesaid decurl image showing the decurl direction of the sheet on the ejection tray, and the aforesaid selection section and the decurl image are indicated on the same selection screen mentioned above.

On the selection screen, there are indicated a selection section that selects a decurl direction given by a decurl device and a decurl image that shows the decurl direction on the sheet ejection tray for sheets. Since the selection section and the decurl image are indicated on the same selection screen, it is possible to confirm, on the image screen, the decurl image after decurl processing on the sheet coping with post-processing conditions. Owing to this, the decurl direction for correcting curls on the sheet having thereon formed images can be set easily.

Owing to this construction, it is possible to set easily the decurl direction for correcting curls on the sheet which has been subjected to image forming, because the decurl image after decurl processing for the sheet coping with post-processing conditions can be confirmed on the image screen. Owing to this, it is possible to prevent erroneous setting of the decurl direction more than conventional methods. In addition, the easy confirmation of the finishing state of image forming products including curl correcting processing has come to be possible, which makes it possible to provide high-quality image forming products.

BRIEF DESCRIPTION OF THE DRAWINGS

FIGS. 2A-2C are diagrams showing the example of structure of image forming system 101 and the example of the state of output for sheet Pa in the case of straight one side face up selection.

FIGS. 3A-3C are diagrams showing the example of the structure of image forming system 102 and showing the state of output for sheet Pa in the case of selection for straight reverse face down.

FIGS. 4A-4C are diagrams showing the example of structure of image forming system 103 and showing the example of the state of output for sheet Pa in the case of selection of center staple.

DETAILED DESCRIPTION OF THE PREFERRED EMBODIMENT

Figure 1A:
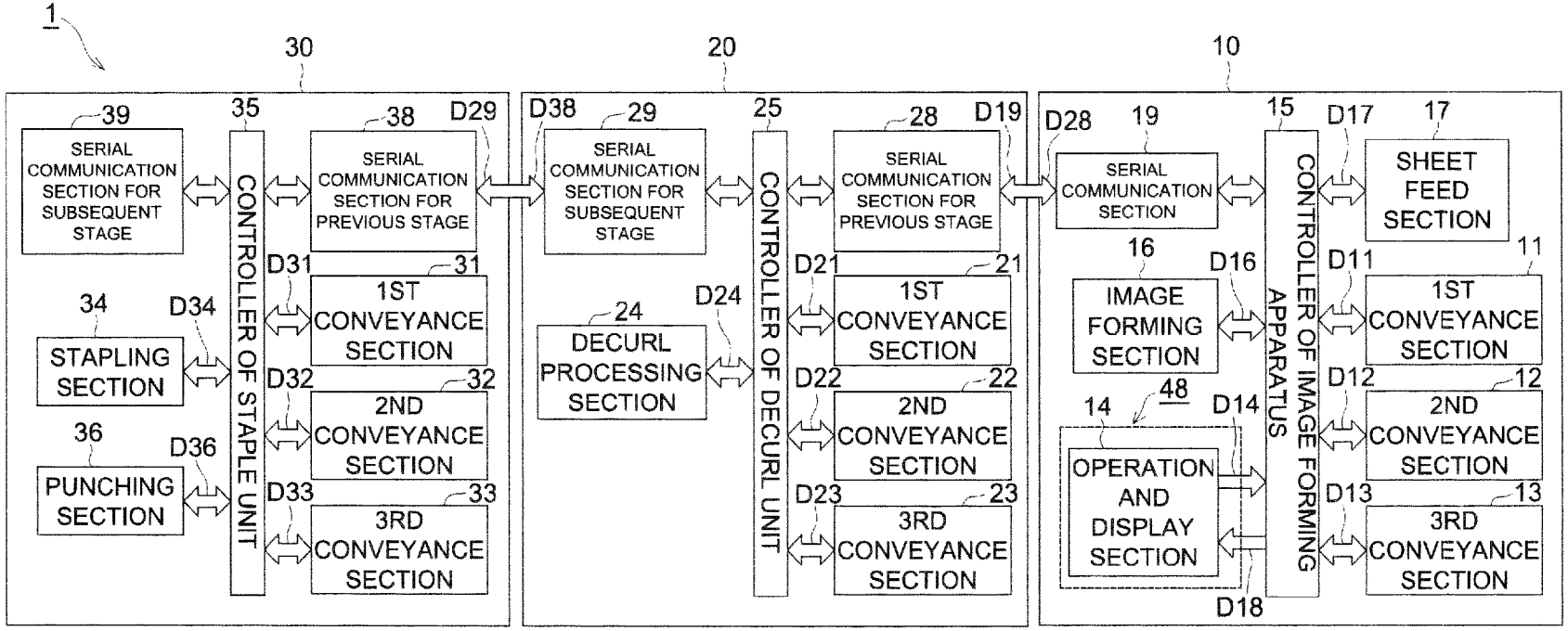
FIGS. 1A and 1B show block diagrams showing an example of the structure of image forming system as an embodiment relating to the invention.
Figure 1B:
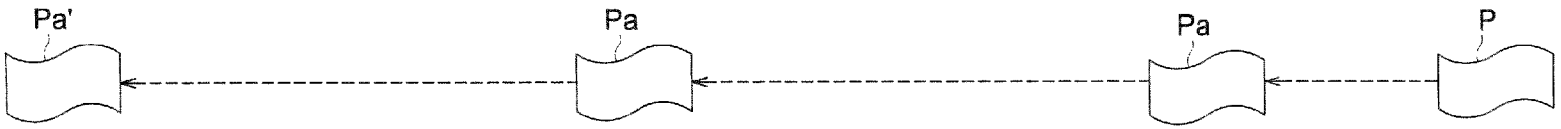

An image forming system relating to an embodiment of the invention will be explained as follows, referring to the drawings. Each of FIGS. 1A and 1B is a block diagram showing an example of the structure of image forming system 1 representing an embodiment of the invention and showing a flow of sheets. The image forming system 1 shown in FIG. 1A is one that can be applied to a printer for a color image forming or a monochrome image forming having a decurl function to correct curls on sheet P on which images have been formed, a copying machine and to a multifunction peripheral having functions of the aforesaid printer and copying machine.

The image forming system 1 is composed to have, for example, image forming apparatus 10, decurl unit 20 and staple unit 30. The image forming apparatus 10 operates to output prescribed sheet P (hereinafter referred to as recorded sheet Pa) on which images have been formed to the decurl unit 20. The decurl unit 20 constitutes an example of a decurl device to correct curls on a sheet on which images nave been formed.

For example, the image forming apparatus 10 inputs post-processing conditions, sets the decurl direction corresponding to the post-processing conditions and outputs a plurality of sheets P after forming images thereon. On the image forming apparatus 10, there is provided controller 15 for the image forming apparatus that constitutes an example of the controller. As the controller 15, there are used CPU, ROM and RAM.

To the controller 15, there are connected first conveyance section 11, second conveyance section 12, third conveyance section 13, operation and display section 14, image forming section 16, sheet feed section 17 and serial communication section 19. The operation and display section 14 has a setting screen on which post-processing conditions are set, and has a selection screen on which a decurl direction to be corrected by decurl unit 120 is selected. On the selection screen there are indicated a selection section for selecting the decurl direction given by decurl unit 20 and a decurl image that shows the decurl direction on the sheet ejection tray for sheet P. The selection section and the decurl image are indicated on the same selection screen. The operation and display section 14 constitutes a touch panel, and indicates the selection section for selecting the decurl direction and decurl images by inputting indication data D18 from the controller 15.

The controller 15 controls the operation and display section 14. The controller 15 controls to switch indication of decurl images on the selection image screen, based on setting of post-processing conditions. For example, the controller 15 controls so that decurl images showing the decurl direction for correcting curls of sheet P after image forming obtained from image forming section 16 may be indicated on the same screen of operation and display section 14.

Further, the operation and display section 14 is operated to input post-processing conditions for sheet Pa. These post-processing conditions include center stapling processing (hereinafter referred to as center staple mode), staple processing (hereinafter referred to as staple mode), Z-shaped fold processing (hereinafter referred to as Z-shaped fold mode), case bind processing (hereinafter referred to as case bind mode), face-up sheet ejection processing (hereinafter referred to as straight one side face-up mode) and face-down sheet ejection processing (hereinafter referred to as straight reversing face-down mode).

The operation and display section 14 is operated to input various established information including image forming conditions such as one-side mode or two-sided mode, sheet type and sheet feed tray, in addition to inputting established information of post-processing conditions. The image forming conditions in this case mean process conditions in the case of forming images on sheets P. Various types of established information set by the operation and display section 14 become operation data D14 to be outputted to controller 15. On the operation and display section 14, there are provided unillustrated key boards and liquid crystal display panels.

The aforesaid operation and display section 14 indicates a decurl image on sheet ejection tray 30*a* for sheet Pa, based on the inputted post-processing conditions. For example, a decurl setting image screen is indicated on operation and display section 14 so that decurl image on sheet ejection tray 30*a* after decurl processing for sheet Pa may be indicated.

In the present example, the operation and display section 14 is operated by a selection section that shows decurl image on sheet ejection tray 30*a* for sheet Pa indicated in the same decurl setting image screen and the decurl direction for the sheet Pa to select decurl processing.

Further, the operation and display section 14 is switched in terms of indication depending on changes in post-processing conditions.

Sheet feed section 17 is connected to controller 15 to feed sheet P in a prescribed size to image forming section 16 based on sheet feed control data D17. On the sheet feed section 17, there are provided, for example, plural sheet feed trays each storing sheets P in a prescribed size. The sheet feed control data D17 are data that control supply of sheet P, and it outputs to the sheet feed section 17 from controller 15.

First conveyance section 11 is connected to controller 15 to feed sheet P to image forming section 16 based on sheet conveyance data D11. The sheet conveyance data D11 are data to control conveyance of sheet P, and they are outputted from controller 15 to the first conveyance section 11. For example, the first conveyance section 11 selects a specific sheet feed tray from plural sheet feed trays based on the sheet conveyance data D11 to feed out sheet P to the image forming section 16.

Second conveyance section 12 is connected to controller 15 to convey sheet P to an unillustrated transfer unit of image forming section 16 based on sheet conveyance data D12. The sheet conveyance data D12 are data which are outputted to the second conveyance section 12 from the controller 15 to control conveyance of sheet P.

Third conveyance section 13 is connected to controller 15 to convey sheet Pa to decurl unit 20 representing a decurl device from image forming section 16, through an unillustrated sheet ejection inlet, based on sheet conveyance data D13. The sheet conveyance data D13 are data which are outputted to the third conveyance section 13 from the controller 15 to control conveyance of sheet Pa. Incidentally, the third conveyance section 13 operates an unillustrated conveyance path for a back side based on the sheet conveyance data D13, to reverse sheet Pa.

Image forming section 16 is connected to controller 15 to input image data D16 for forming an image on sheet P. The image forming section 16 is constructed to have an unillustrated photoconductor drum, a charging unit, a writing unit, a developing unit, a transfer unit, a fixing unit and a cleaning section.

In the present example, the image forming section 16 forms images on plural sheets P to output them, based on image forming conditions inputted by operation and display section 14. On image forming apparatus 10, there are provided sheet conveyance modes such as, for example, a straight one side face-up mode, a straight reversal face-down mode (which will be also called a one-side mode simply, hereafter), and a two-sided image forming mode (which will be also called a two-side mode simply, hereafter).

In the straight one side face-up mode, sheet Pa which has been conveyed through the third conveyance section 13 is conveyed as it is to the sheet ejection inlet, to be ejected out. In the straight reversal face-down mode, an image is formed on one side of sheet P by the image forming section 16, and sheet Pa which has passed through fixing processing is conveyed to the sheet ejection inlet to be ejected out, after being turned over inside out.

For example, when a one-side mode is set on the image forming section 16, image data D16 are inputted in the image forming section 16, and sheet P is supplied from the selected sheet feed tray. On the image forming section 16, when the photoconductor drum is charged, the writing unit forms an electrostatic latent image on the photoconductor drum based on image data D16. The electrostatic latent image is developed by toner. A toner image thus formed is transferred onto a prescribed surface of sheet P that is supplied from a sheet feed tray. The toner image transferred onto sheet P is fixed. The sheet P after fixing is ejected out.

Under the two-side mode, sheet Pa that has subjected to image forming on its one side and has passed through fixing processing in image forming section 16 runs downward to advance through a conveyance path for a back side, and is reversed inside out to be supplied again to the image forming section 16. On the back side of the sheet Pa thus supplied again, there is formed an image for a back side by the image forming section 16. The sheet Pa on which images have been formed on its back side passes through fixing processing and is conveyed to a sheet ejection inlet to be ejected out.

Further, serial communication section 19 is connected to controller 15 to be used when communicating with decurl unit 20 or staple unit 30. Image forming apparatus 10 and decurl unit 20 are connected with an unillustrated communication cables. The communication cables are caused to connect between serial communication section 19 and serial communication section 28 for the front step of decurl unit 20. A communication modem is used as serial communication sections 19 and 28. The serial communication section 19 receives, for example, serial up communication data D28 to output them to the controller 15, and inputs serial down communication data D19 from controller 15 to transmit to decurl unit 20.

When the image forming apparatus 10 is constructed as stated above, it is possible to switch the indication depending on changes of post-processing conditions of operation and display section 14. Therefore, it is possible to set the decurl direction of sheet Pa corresponding to the aforesaid post-processing conditions, while confirming the state on the sheet ejection tray 30*a* after decurl processing for sheet Pa following changes of post-processing conditions such as a center staple mode, a staple mode, a z-shaped folding mode, a case binding mode, a straight one side face-up mode, and a straight reversal face-down mode.

Decurl unit 20 has a curl correction function. The decurl unit 20 conducts curl correction processing for sheet Pa based on the curl direction established by image forming apparatus 10. For example, the decurl unit 20 is caused to conduct decurl processing in the concave direction or in the convex direction for sheet Pa outputted from image forming apparatus 10.

The decurl unit 20 is composed to have, for example, first conveyance section 21, second conveyance section 22, third conveyance section 23, decurl processing section 24, controller 25 for decurl unit, serial communication section 28 for the front step and serial communication section 29 for the rear step. The serial communication section 28 is connected to controller 25. The serial communication section 28 carries out serial communication with image forming apparatus 10 based on up communication data D28 and down communication data D19.

For example, serial communication section 28 transmits up communication data D28 to image forming apparatus 10. The serial communication section 28 receives down communication data D19 from image forming apparatus 10, and carries out serial communication between controller 25 of the decurl unit 20 and controller 15 of image forming apparatus 10. In the present example, the controller 15 sets the decurl direction on the controller 25.

The controller 25 controls input and output of the first conveyance section 21, the second conveyance section 22, the third conveyance section 23, the decurl processing section 24 and the serial communication section 29 for the rear step, based on down communication data D19 from image forming apparatus 10. CPU (Central Processing Unit) is used for the controller 25. The controller 25 controls decurl processing section 24 based on the decurl direction established from the controller 15.

The first conveyance section 21 is connected with the controller 25, and is caused to convey sheet Pa to the decurl processing section 24 based on conveyance control data D21. The conveyance control data D21 are those to control the conveyance of sheet Pa, and are outputted from the controller 25 to the first conveyance section 21.

The second conveyance section 22 is connected with the controller 25, and is caused to convey sheet Pa in the decurl processing section 24 based on conveyance control data D22. The conveyance control data D22 are those to control and convey sheet Pa, and are outputted from the controller 25 to the second conveyance section 22.

The decurl processing section 24 is connected with the controller 25, to carry out curl correction processing for sheet Pa based on a one-side mode or a two-side mode in terms of an image formed by image forming section 16, and to output the sheet Pa which has been corrected in terms of curls. For example, the decurl processing section 24 corrects curls by causing sheet Pa to pass through a zigzag conveyance path having a prescribed length, based on decurl processing data D24, and in an example, sheet Pa whose image surface is convex in terms of a curl is made to be sheet Pa whose image surface is concave (first decurl processing).

The decurl processing section 24 corrects curls of sheet Pa by causing sheet Pa after its first decurl processing to pass through a zigzag conveyance path having a prescribed length in an opposite direction, and in an example, sheet Pa whose image surface is concave in terms of a curl is made to be sheet Pa whose image surface is convex (second decurl processing). Further, the decurl processing section 24 causes sheet Pa after the second decurl processing to pass through a zigzag conveyance path that is longer than that in the case of the first decurl processing, to correct curls and waviness shapes which are still remaining even after curl corrections by the first and second decurl operations, and thereby, to achieve a flat surface that is free from irregularities (third decurl processing). Decurl processing data D24 are data to correct curls of sheet Pa, and are outputted from controller 25 to decurl processing section 24.

The third conveyance section 23 is connected with the controller 25, and is caused to convey sheet Pa after curl correction processing to staple unit 30 through a sheet ejection inlet based on conveyance control data D23. The conveyance control data D23 are those to control the conveyance of sheet Pa after curl correction processing, and are outputted from the controller 25 to the third conveyance section 23.

Serial communication section 29 is connected with the controller 25 to carry out communication with staple unit 30, based on serial up communication data D38 and down communication data D29. For example, the serial communication section 29 transmits down communication data D29 to staple unit 30. The serial communication section 29 receives up communication data D38 from staple unit 30, and carries out serial communication between controller 25 of the decurl unit 20 and controller 35 of staple unit 30. In the present example, the controller 15 is caused to set post-processing conditions on the controller 35.

Staple unit 30 constituting an example of a sheet finisher is connected to the downstream side of decurl unit 20, and decurl processing is conducted on sheet Pa after image forming, and reversing and staple processing or punch processing accompanied by rotation are conducted on the sheet Pa. Sheet Pa after post-processing is ejected on sheet ejection tray 30*a*. The sheet ejection tray 30*a* is one on which sheets Pa ejected from a sheet finisher such as staple unit 30 are stacked.

The staple unit 30 has therein, for example, first conveyance section 31, second conveyance section 32, third conveyance section 33, staple section 34, controller 35 for a sheet finisher, punch section 36, serial communication section 38 for the front step and serial communication section 39 for the rear step. The serial communication section 38 is connected with controller 35. The serial communication section 38 carries out serial communication with image forming apparatus 10, based on up communication data D28 and down communication data D19.

For example, the serial communication section 38 transmits up communication data D88 to decurl unit 20. The serial communication section 38 receives down communication data D29 from decurl unit 20, and carries out serial communication between controller 35 of the staple unit 30 and controller 25 of decurl unit 20. In the present example, the controller 25 is caused to transfer post-processing conditions coming from image forming apparatus 10 to controller 35.

The controller 35 controls input and output for first conveyance section 31, second conveyance section 32, third conveyance section 33, staple section 34, punch section 36 and for serial communication section 39 for the rear step, based on down communication data D29 from decurl unit 20.

First conveyance section 31 is connected with controller 35 to be caused to convey sheet Pa after decurl processing to staple section 34, based on conveyance control data D31. The conveyance control data D31 are data for conveying and controlling sheet Pa, and they are outputted from controller 35 to the first conveyance section 31.

Second conveyance section 32 is connected with controller 35 to be caused to convey sheet Pa after decurl processing in staple section 34, based on conveyance control data D32. The conveyance control data D32 are data for conveying and controlling sheet Pa after decurl processing, and they are outputted from controller 35 to the second conveyance section 32.

Staple section 34 is connected with controller 35 to carry out staple processing for sheet Pa that has been processed in terms of decurls by decurl processing 24, and the staple section 34 outputs sheet Pa after staple processing (booklet Pa'). For example, the staple section 34 conducts staple processing for sheet Pa after decurl processing, based staple control data D34. The staple control data D34 are data for conducting staple processing for sheet Pa, and they are outputted from controller 35 to staple section 34.

The punch section 36 is connected with controller 35 to conduct punch processing for sheet Pa which has been processed in terms of decurling by decurl processing section 24, and to output sheet Pa on which a punched hole is opened. The punch section 36, for example, opens a punched hole on sheet Pa after decurl processing, based on punch control data D36. The punch control data D36 are data with which the sheet Pa is processed so that a hole may be opened, and they are outputted from controller 35 to punch section 36.

Third conveyance section 33 is connected with controller 35 to be caused to convey booklet Pa' after staple processing and sheet Pa after punch processing to an unillustrated sheet ejection inlet, based on conveyance control data D33. The conveyance control data D33 are data to control the conveyance of sheet Pa after staple processing and of sheet Pa after punch processing, and they are outputted from the controller 35 to the third conveyance section 33.

Serial communication section 39 is to be connected with controller 35. It is connected through an unillustrated communication cable when another sheet finisher is arranged on the downstream side of the staple unit 30, and it transmits down communication data D39 to another sheet finisher, to carry out serial communication with the staple unit 30. As the other sheet finishers, a case binding unit and a center stapling unit are used. On the case binding unit, a plurality of sheets Pa are bundled, and a piece of paper for a dual page print is caused to be pasted on an edge surface of a bundle of sheets. On a center staple unit, plural sheets Pa are folded double and are stapled with staples on a crease of the folded sheets to be ejected.

Next, there will be explained image forming systems 101, 102 and 103 each of which is equipped with decurl processing section 24 that conducts decurl processing in the direction of irregularities for sheet Pa during transit, and corresponds to post-processing conditions.

Each of FIGS. 2A-2C is a diagram showing an example of the structure of image forming system 101 and an example of the state of output of sheet Pa in the case of straight one side face up selection. The image forming system 101 shown in FIG. 2A is in the occasion wherein decurl unit 20 and staple unit 30 are equipped as a sheet finisher, and image forming apparatus 10 is connected with decurl unit 20, and further, staple unit 30 is connected with decurl unit 20, whereby, the image forming system 101 is constituted.

FIG. 2B is a diagram showing an example of the state of output of sheet Pa in the case of setting concaveness. In the case of sheet Pa for setting concaveness shown in FIG. 2B, straight one side face up is selected as post-processing conditions in the image forming apparatus 10, and decurl processing in the concave direction is conducted for sheet Pa by decurl unit 20. In the state of output of the sheet Pa in this case, its image surface is concave.

FIG. 2C is a diagram showing an example of the state of output of sheet Pa in the case of setting convexness. In the case of sheet Pa for setting concaveness shown in FIG. 2C, straight one side face up is selected in the image forming apparatus 10, and decurl processing in the convex direction is conducted for sheet Pa by decurl unit 20. In the state of output of the sheet Pa in this case, its image surface is convex.

Under the condition of no curl in image forming apparatus 10, in image forming system 101 as in the foregoing, when face up output is selected by one side printing, the state of sheet Pa outputted to sheet ejection tray 30*a* finally becomes to be concave state in terms of image surface side when decurling in the concave direction is set, and it becomes to be concave state in terms of image surface side when decurling in the convex direction is set.

Therefore, it is possible to indicate decurl images showing the state of decurl of sheet Pa outputted to sheet ejection tray 30*a* and a selection button for setting decurl in the concave direction or the convex direction on the same image screen, when selecting straight one side face up, and thereby, to set decurl in the concave direction or in the convex direction, while referring to decurl images showing the state of decurl of sheet Pa indicated on the same image screen.

Each of FIGS. 3A-3C is a diagram showing an example of the structure of image forming system 102 and an example of the state of output of sheet Pa in the case of straight reversing face down selection. The image forming system 102 shown in FIG. 3A is equipped with decurl unit 20 representing a sheet finisher, staple unit 30 and with reversing unit 40, which show an occasion wherein the decurl unit 20 is connected with image forming apparatus 10, then, the reversing 40 is connected with the decurl unit 20, and further, the stable unit 30 is connected with the reversing unit 40 to constitute the image forming system 102.

FIG. 3B is a diagram showing an example of the state of output of sheet Pa in the case of setting concaveness. Sheet Pa in the case of setting concaveness shown in FIG. 3B shows an occasion wherein straight reversing face down is selected as post-processing conditions in image forming apparatus 10, and decurl processing in the concave direction has been carried out for sheet Pa. The state of output of sheet Pa in this case is one wherein its image surface takes a concave shape.

FIG. 3C is a diagram showing an example of the state of output of sheet Pa in the case of setting convexness. Sheet Pa in the case of setting convexness shown in FIG. 3C shows an occasion wherein straight reversing face down is selected in image forming apparatus 10, and decurl processing in the convex direction has been carried out for sheet Pa. The state of output of sheet Pa in this case is one wherein its image surface takes a convex shape.

Under the condition of no curl in image forming apparatus 10, in image forming system 102 as in the foregoing, when face-down output is selected by one side printing, the state of output for sheet Pa outputted to sheet ejection tray 30*a* finally becomes to be concave state in terms of image surface side when decurling in the concave direction is set, and it becomes to be convex state in terms of image surface side when decurling in the convex direction is set.

Therefore, it is possible to indicate decurl images showing the state of decurl of sheet Pa outputted to sheet ejection tray 30*a* and a selection button for setting decurl in the concave direction or the convex direction on the same image screen, when selecting straight reversing face down, and thereby, to set decurl in the concave direction or in the convex direction, while referring to decurl images showing the state of decurl of sheet Pa indicated on the same image screen. Incidentally, when face up output is selected by one side printing in image forming system 102, relationship between setting concaveness or convexness and the state of decurl in image forming system 101 becomes the same.

Each of FIGS. 4A-4C is a diagram showing an example of the structure of image forming system 103 and an example of the state of output of sheet Pa in the case of selection of center staple. The image forming system 103 shown in FIG. 4A is in the occasion wherein decurl unit 20 and center staple unit 50 are provided as a sheet finisher, and image forming apparatus 10 is connected with decurl unit 20, and further, center staple unit 50 is connected with decurl unit 20, whereby, the image forming system 103 is constituted. The center staple unit 50 has sheet ejection stocking section 50*a* that stores booklets. The center staple processing is accompanied by reversing of sheet Pa and by its twofold processing.

FIG. 4B is a diagram showing an example of the state of output of sheet Pa in the case of setting concaveness. Sheet Pa in the case of setting concaveness shown in FIG. 4B is in the state wherein decurl processing in the direction of concaveness is conducted for sheet Pa by decurl unit 20 as post-processing conditions when center staple processing is selected in image forming apparatus 10. The state of output for the sheet Pa in this case is in the direction in which a booklet is opened, namely, the direction in which both edges of the sheet Pa are rolled out.

FIG. 4C is a diagram showing an example of the state of output of sheet Pa in the case of setting convexness. Sheet Pa in the case of setting convexness shown in FIG. 4C is in the state wherein decurl processing in the direction of convexness is conducted for sheet Pa by decurl unit 20 when center staple processing is selected in image forming apparatus 10. The state of output for the sheet Pa in this case is in the direction in which a booklet is closed, namely, the direction in which both edges of the sheet Pa are caught up inside.

In the image forming system 103, as stated above, when center staple processing is selected, the state of output for the sheet Pa outputted finally to sheet ejection stocking section 50*a* is in the form to catch up both edges of the sheet inside when decurl setting in the direction of concaveness is conducted, and is in the form to roll both edges of the sheet out when decurl setting in the direction of convexness is conducted.

Therefore, it is possible to indicate decurl images showing the state of decurl of sheet Pa outputted to sheet ejection stocking section 50*a* and a selection button for setting decurl processing in the concave direction or the convex direction on the same image screen of operation and display section 14, when center staple is selected, and thereby, to set decurl in the concave direction or in the convex direction, while referring to decurl images showing the state of decurl of sheet Pa indicated on this same image screen.

Figure 5:
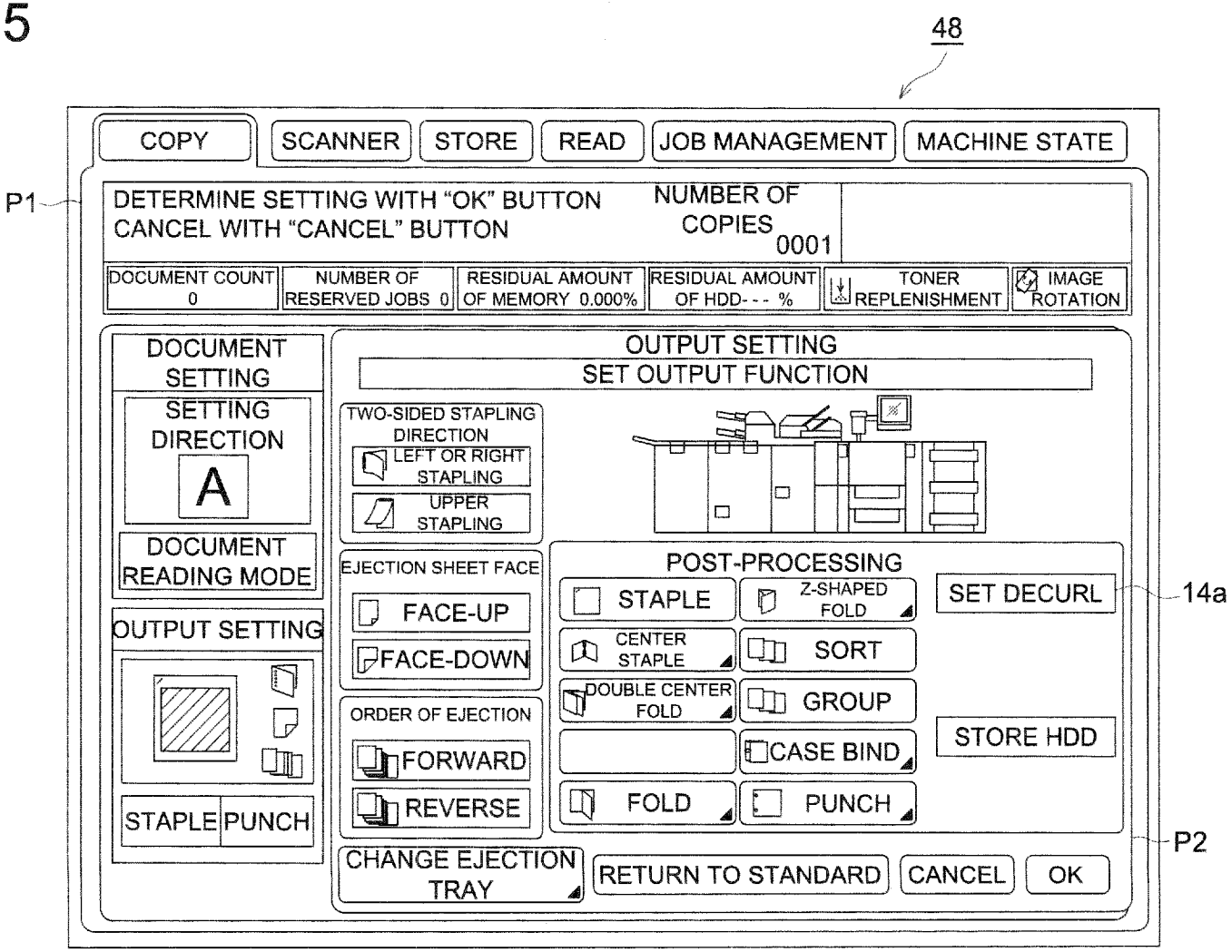
FIG. 5 is a diagram showing an example of display of copy operation image screen P1 of touch panel 48.

FIG. 5 is a diagram showing an example of indication of copy operation image screen P1 of touch panel 48 that constitutes the operation and display section 14. In the present example, decurl unit 20, an unillustrated punch unit, staple unit 30 and center staple unit 50 are combined, to show copy operation image screen P1 in the image forming system that is composed of the aforesaid sheet finishers connected to image forming apparatus 10.

The copy operation image screen P1 of touch panel 48 shown in FIG. 5 shows an occasion wherein "copy" is selected. On the copy operation image screen P1, there are provided icons for "scanner", "store", "read", "job management" and "machine state" in addition to "copy". On the copy operation image screen P1, there are indicated pieces of character information such as "determine setting with "OK" button" and "cancel" with "cancel" button".

In addition to the character information, the copy operation image screen P1 indicates thereon icons for "document count", "number of reserved jobs", "residual amount of memory", "residual amount of HDD", "toner replenishment", "image rotation". Furthermore, in addition to the aforesaid icons, there are indicated an icon of "document setting" and icons of "setting direction A" and "document reading mode". Below this icon of "document reading mode", there is indicated an icon of "output setting". Below the icon of "output setting", there are indicated post-processing conditions. In the present example, two icons for "staple" and "punch" are arranged selectively.

In the present example, output setting display image screen P2 that has popped up from the copy operation image screen P1 is indicated, when the icon of "output setting" is selected. On the output setting display screen P2, there is indicated character information of "set output function", as post-processing conditions. Further, below the icon of "two-sided stapling direction", each of the icons of "left or right stapling" and of "upper stapling" is indicated. Below the icon of "upper stapling", there is indicated the icon of "ejection sheet face". Below the icon of "ejection sheet face", there is indicated each of the icons of "face-up" and "face-down". Below the icon of "face-down", there is indicated the icon of "order of ejection". Below the icon of "order of ejection", there is indicated each of the icons of "forward ejection" and of "reverse ejection".

Further, for the post-processing conditions, there are indicated icons for selecting various modes including "staple", "center staple", "double center fold", "fold", "Z-shaped fold", "sort", "group", "case bind" and "punch" on the output setting display screen P2, as a post processing mode. Further, there are indicated icons for "change ejection tray", "return to standard", "cancel" and "OK", on the output setting display screen P2. Post processing modes are selectable, and they are different depending on combination of finishers such as image forming systems 101, 102 and 103.

On the output setting display screen P2, a user is caused to set desired post-processing conditions. In the present example, with respect to a sheet ejection surface of sheet Pa, each mode for "face-up" or "face-down" is selectable. Further, when a staple mode shown in FIG. 5 is selected, face-down is automatically selected. This is caused by a structural restriction of staple unit 30.

On the output setting display screen P2, an icon of "set decurl" is indicated on the right side of a post-processing mode. Icon 14*a* of "set decurl" is a selection section to constitute operation and display section 14, and it makes it possible to select the concave or convex direction for sheet Pa (decurl direction selection function). For example, if icon 14*a* of "set decurl" is selected, decurl direction setting screen P21 that has further popped up is caused to be indicated popped up from the output setting display screen P2 is caused to be indicated (see FIG. 6).

Figure 6:
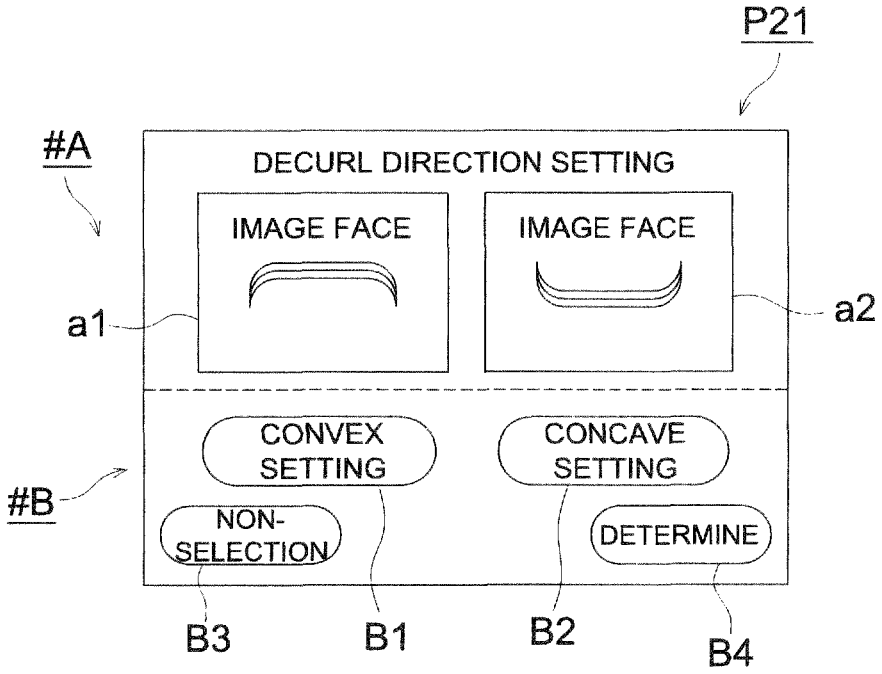
FIG. 6 is an image screen structural diagram showing an example of display of decurl direction setting image screen P21 in the case of selection for straight one side face up in the post-processing mode.

Next, decurl direction setting screens P21-P23 will be explained as follows, referring to FIGS. 6-8. FIG. 6 is a screen structural diagram showing an example of display of decurl direction setting screen P21 in the case of selecting straight one side face-up in a post-processing mode. To the decurl direction setting screen P21 shown in FIG. 6, there are assigned output image display area #A and button display area #B for setting decurl direction.

In the present example, the output image display area #A is divided into two display areas, and on display area a1 on one side, there is displayed a decurl image on sheet ejection tray 30*a* after decurl processing of sheet Pa corresponding to a straight one side face-up mode. On the display area a1, there is displayed a decurl image whose image surface is convex as a decurl image on sheet ejection tray 30*a* after decurl processing. The decurl image in this case shows the state of being outputted to sheet ejection tray 30*a* to indicate an effect by decurl setting. On display area a2 on the other side, there is displayed a decurl image whose image surface is concave that is for setting decurl processing.

The button display area #B for setting decurl direction is displayed in possession of button B1 for setting convexness constituting an example of the first selection button. When an image surface of the sheet Pa becomes to be concave corresponding to post-processing conditions, the button B1 is depressed so that a decurl direction of sheet Pa obtained from image forming section 16 may be set to be convex.

Further, in the same decurl direction setting screen P21, there is indicated in possession of button B2 for setting concaveness constituting an example of the second selection button. When an image surface of the sheet Pa becomes to be convex corresponding to straight one side face-up mode, the button B2 is depressed so that a decurl direction of sheet Pa may be set to be concave.

Further, in the same decurl direction setting screen P21, there is indicated non-selection button B3, and it is depressed so that both selections for setting convexness and setting concaveness may become invalid, concerning a decurl direction of sheet Pa. In addition, confirmation button B4 that decides a selection by the decurl direction setting screen P21 is indicated on a selection screen of operation and display section 14, and the confirmation button B4 is depressed when deciding input by each of button B1 for setting convexness, button B2 for setting concaveness and non-selection button B3. Each of various buttons B1-B4 is depressed when giving instructions of the direction that can be set by the image forming system 1 to controller 15.

When touch panel 48 for screen display input is constituted as in the foregoing, it is possible to indicate, on the same decurl direction setting screen P21, selection buttons for selecting decurl images of sheet Pa on sheet ejection tray 30*a* and decurl directions for the sheet Pa. Whereby, it is possible to set easily a decurl direction of sheet Pa corresponding to post-processing conditions, while confirming, on the screen, the state of decurl on sheet ejection tray 30*a* for sheet Pa after decurl processing corresponding to post-processing conditions.

In this example, when post-processing conditions are changed by various icons of touch panel 48 (operation and display section 14), decurl images of sheet Pa corresponding to the changes of post-processing conditions and selection buttons for selecting decurl directions for correcting curls of sheet Pa are indicated after being switched. For example, controller 15 of image forming apparatus 10 is caused to indicate decurl images corresponding to the selected post-processing conditions and effects in the case of setting decurl processing in concaveness direction or convexness direction, together on the operation and display section 14. Thus, it is possible to indicate the decurl images corresponding to button B1 for setting convexness and button B2 for setting concaveness.

Figure 7:
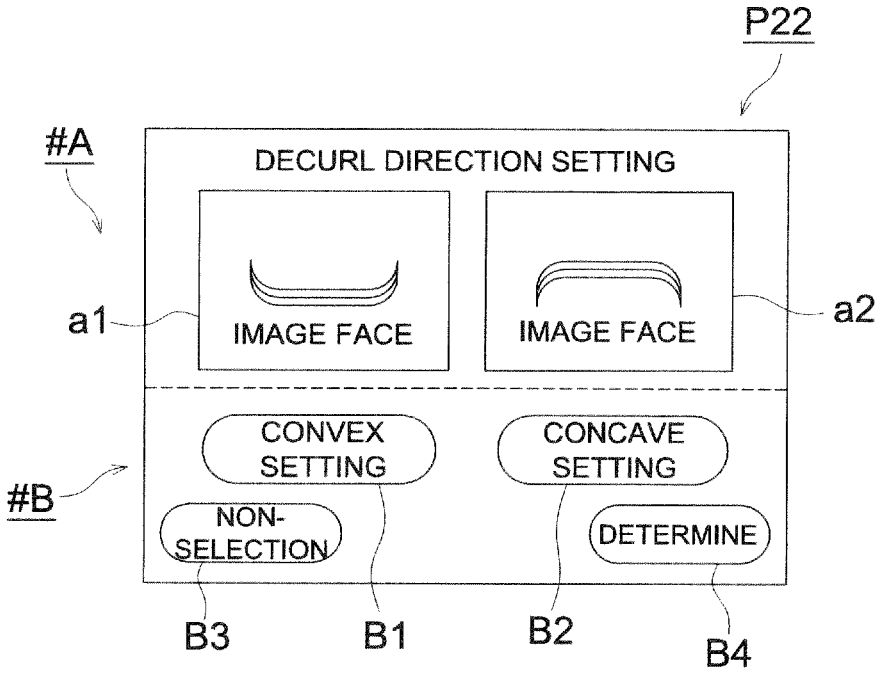
FIG. 7 is an image screen structural diagram showing an example of display of decurl direction setting image screen P22 in the case of selection for straight reversing face down in the post-processing mode.

FIG. 7 is a screen structural diagram showing an example of display of decurl direction setting screen P22 in the case of selecting straight reversing face-down in a post-processing mode. Also to the decurl direction setting screen P22 shown in FIG. 7, there are assigned output image display area #A and button display area #B for setting decurl direction.

On display area a1 on one side of the output image display area #A, there is displayed a decurl image on sheet ejection tray 30*a* for sheet Pa after decurl processing corresponding to straight reversing face-down mode. On the display area a1, there is displayed sheet Pa whose image surface is convex after decurl processing. The decurl image in this case is one that shows a decurl image in the state outputted to sheet ejection tray 30*a*, and expresses effects by decurl setting. On display area a2 on the other side, there is displayed sheet Pa whose image surface for setting decurl processing is concave.

On decurl direction setting button display area #B, there is displayed button B1 for setting convexness. The button B1 is depressed so that a decurl direction of sheet Pa may be set to be convex, when an image surface becomes to be concave, corresponding to straight reversing face-down mode.

Further, button B2 for setting concaveness is indicated on the same decurl direction setting screen P22. When an image surface becomes to be convex, corresponding to straight reversing face-down mode, the button B2 is depressed so that decurl direction of sheet Pa may be set to be concave. Further, on the same decurl direction setting screen P22, there are indicated non-selection button B3 and confirmation button B4. However, explanations for them will be omitted here because functions of them are the same as those on the decurl direction setting screen P21.

Figure 8:
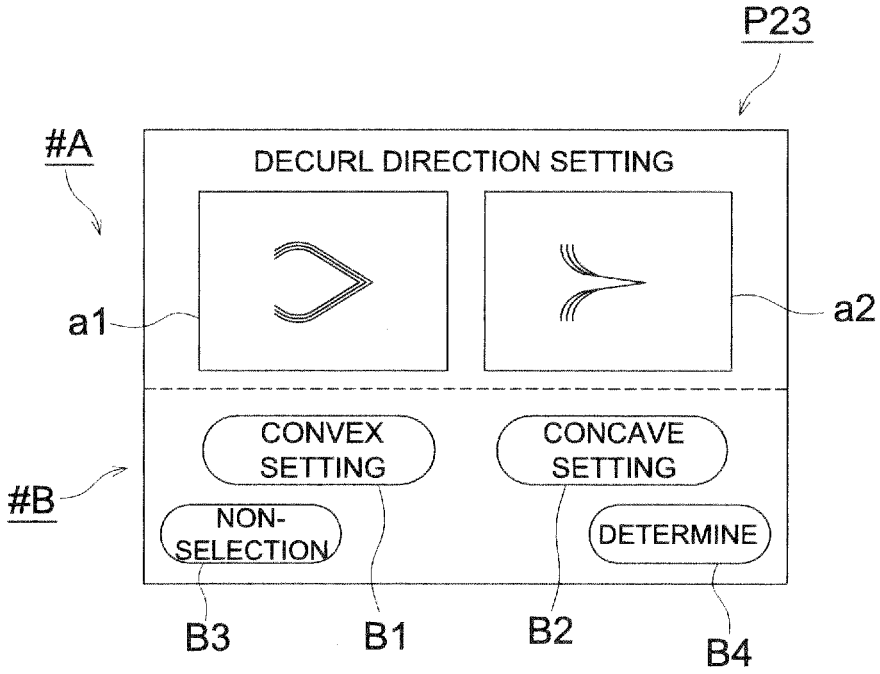
FIG. 8 is an image screen structural diagram showing an example of display of decurl direction setting image screen P23 in the case of selection for center staple in the post-processing mode.

FIG. 8 is an image screen structural diagram showing an example of display of decurl direction setting image screen P23 in the case of selection for center staple in the post-processing mode. Output image display area #A and button display area #B for setting decurl direction are assigned also to the decurl direction setting screen P23 shown in FIG. 8.

In the present example, a decurl image on sheet ejection tray 30*a* after decurl processing of sheet Pa corresponding to a center staple mode is indicated on display area a1 on one side of output image display area #A. On the display area a1, there is displayed a decurl image whose sheet edges are rolled inside as the state on the sheet ejection tray 30*a* after decurl processing. The decurl image in this case shows the state of being outputted to sheet ejection tray 30*a* to indicate an effect by decurl setting. On display area a2 on the other side, there is displayed a decurl image whose sheet edges for setting decurl processing are rolled out.

Selection button B1 for setting convexness is indicated on decurl direction setting button display area #B. The selection button B1 is depressed so that the decurl direction of sheet Pa is set convexness, when sheet edge portion for setting decurl processing becomes to be in a shape where sheet edge portions of the sheet Pa are rolled out, corresponding to center staple mode. When this convexness setting is conducted, decurl processing section 24 conducts decurl processing so that sheet edge portions of sheet Pa may be rolled inside.

Further, selection button B2 for setting concaveness is indicated on the same decurl direction setting screen P23. The selection button B2 is depressed so that decurl direction of sheet Pa may be set concaveness, when sheet edge portions of the sheet Pa become to be in a shape where they are rolled. When this concaveness setting is conducted, decurl processing section 24 conducts decurl processing so that sheet edge portions of sheet Pa may become to be in a shape where they are rolled out.

Results of output in the concaveness direction and convexness direction of sheet Pa after decurl processing have close relationship with post-processing conditions and with conveyance paths, as stated above. Despite the aforesaid close relationship, decurl direction can be determined easily, without understanding the aforesaid relationship.

Figure 9:
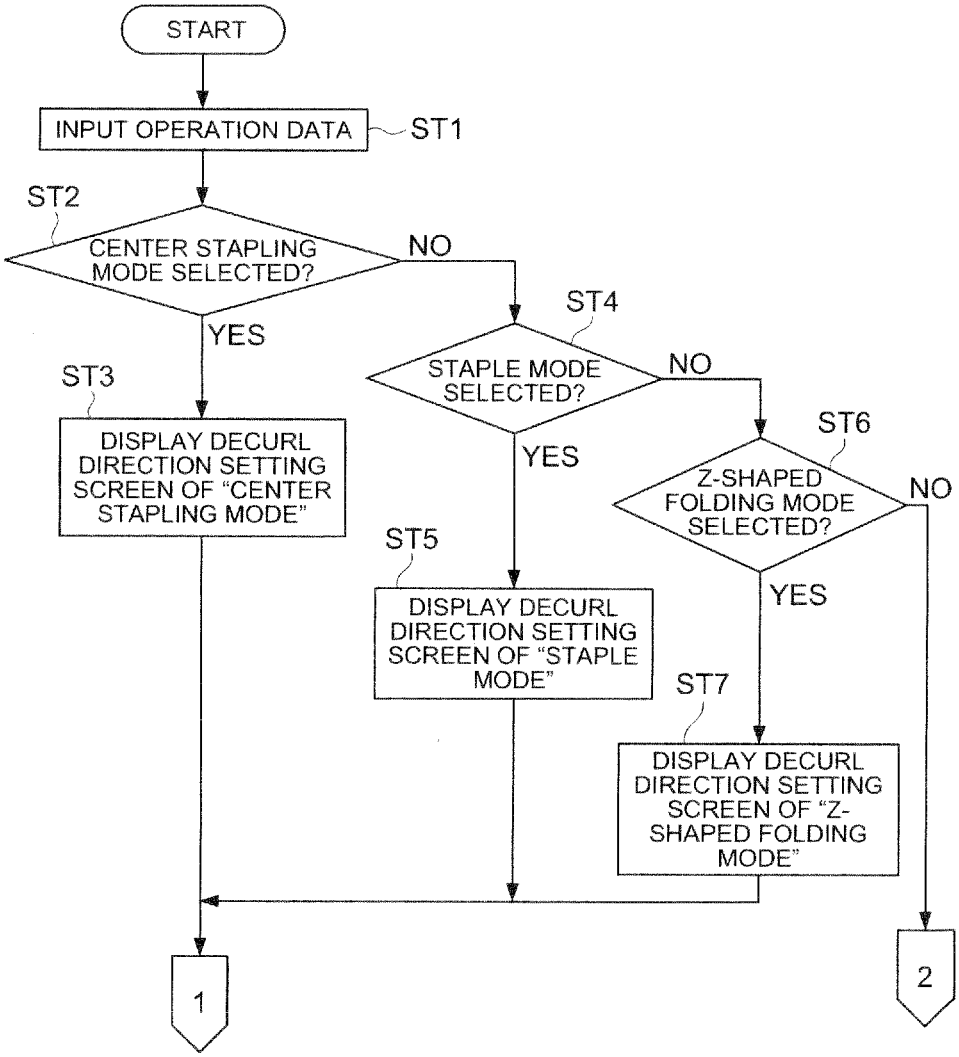
FIG. 9 is a flow chart showing an example of setting a decurl direction (Part 1) in image forming apparatus 10 such as image forming system 103.
Figure 10:
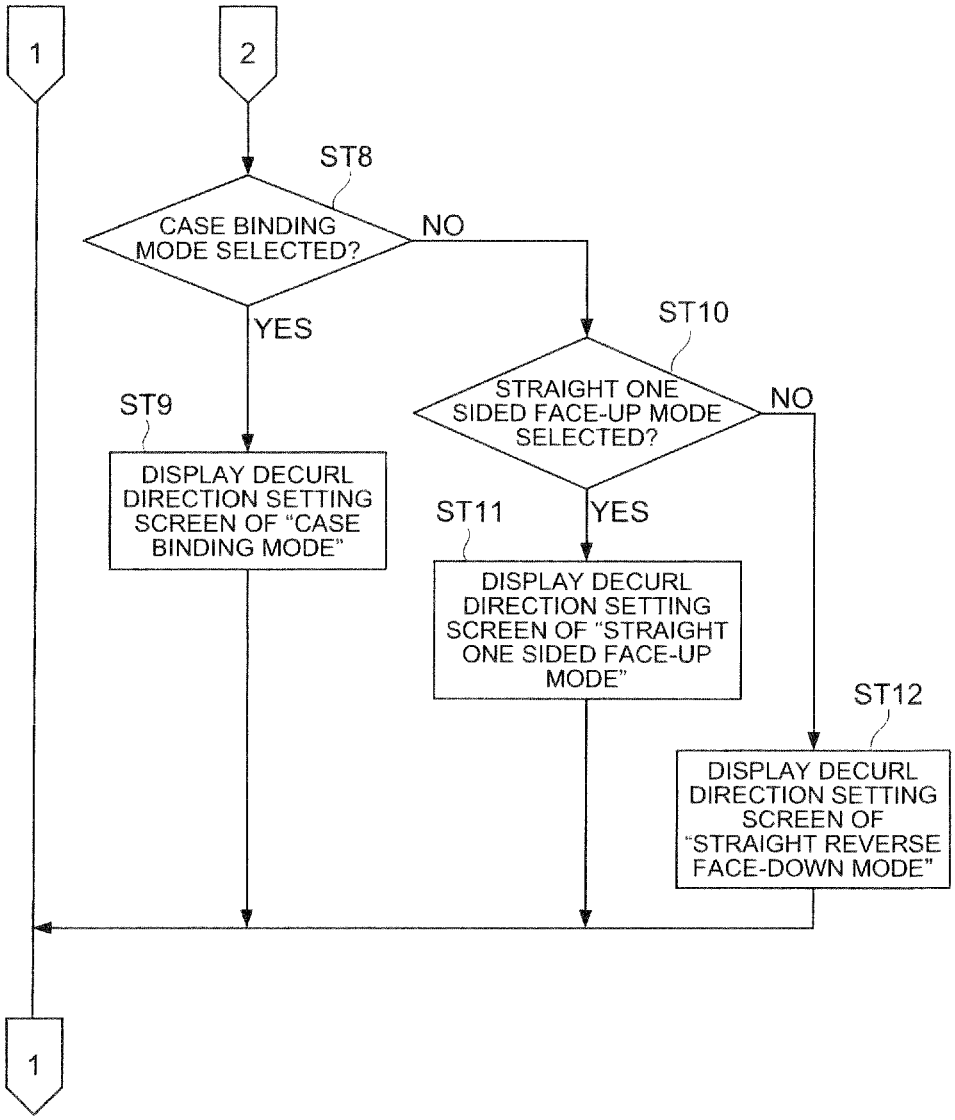
FIG. 10 is a flow chart showing an example of setting a decurl direction (Part 2) in image forming apparatus 10 such as image forming system 103.
Figure 11:
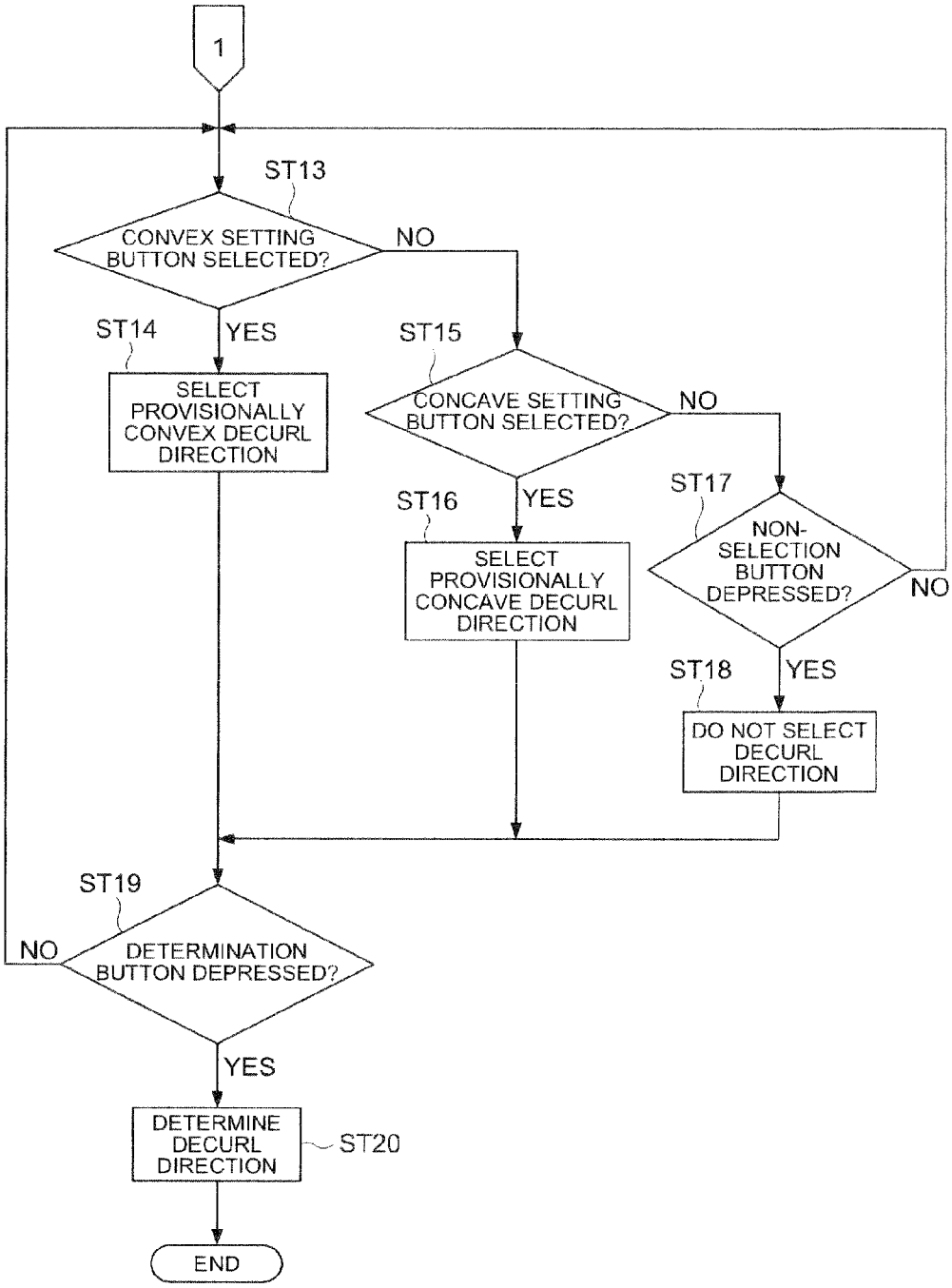
FIG. 11 is a flow chart showing an example of setting a decurl direction (Part 3) in image forming apparatus 10 such as image forming system 103.

Each of FIGS. 9-11 is a flow chart showing an example of setting a decurl direction (Parts 1-3) in image forming apparatus 10. In the present example, there are given occasions having six post-processing modes including a center staple mode, a staple mode, a Z-shaped folding mode, a case binding mode, a straight one side face-up mode and a straight reversing face-down mode. There will be given occasions to develop output setting display screen P2 and to indicate decurl direction setting screens P21, P22 and P23.

Concerning decurl direction setting conditions, controller 15 accepts operation data D14 from touch panel 48 first, in step ST1 of a flow chart shown in FIG. 9. Next, in step ST2, the controller 15 judges whether "center stapling mode" of the post-processing condition has been selected or not, as the post-processing condition.

When the "center stapling mode" has been selected, a flow runs to step ST3, and the controller 15 develops decurl direction setting screen P23 of the "center stapling mode". On the decurl direction setting screen P23, center staple processing is applied on sheet Pa as a decurl image, and a decurl image of sheet Pa in the state to be ejected on sheet ejection stock section 50*a* (sheet ejection tray) is caused to be indicated. See FIG. 8 for the decurl direction setting screen P23 of "center stapling mode".

Further, when the "center stapling mode" has not been selected, a flow runs to step ST4, and the "center stapling mode" is judged whether it has been selected or not. When the "center stapling mode" has been selected, a flow runs to step ST5, and controller 15 develops a decurl setting screen of the "center stapling mode". Staple processing is applied on sheet Pa as a decurl images and the decurl image in the state to be ejected on sheet ejection tray 30*a* is displayed on this decurl setting screen.

When the "stapling mode" has not been selected, a flow runs to step ST6, and "Z-shaped folding mode" is judged whether it has been selected or not. When the "Z-shaped folding mode" has been selected, a flow runs to step ST7, and controller 15 develops a decurl setting screen of the "Z-shaped folding mode". Z-shaped fold processing is applied on sheet Pa as a curl image, and a decurl image of sheet Pa in the state to be ejected to an unillustrated sheet ejection tray is indicated on this decurl setting screen.

Further, when the "Z-shaped folding mode" has not been selected, a flow runs to step ST8 shown in FIG. 10, and "case binding mode" is judged whether it has been selected or not. When the "case binding mode" has been selected, a flow runs to step ST9, and controller 15 develops a decurl setting screen of the "case binding mode". On this decurl setting screen, there is displayed a decurl image of sheet Pa in the case wherein case binding processing is applied on sheet Pa as a decurl image, and the sheet Pa is ejected to an unillustrated sheet ejection stacker.

When the "case binding mode" has not been selected, a flow runs to step ST10, and "straight one side face-up mode" is judged whether it has been selected or not. When "straight one side face-up mode" has been selected, a flow runs to step ST11, and controller 15 develops decurl direction setting screen P21 of the "straight one side face-up mode" (see FIG. 6). On this decurl direction setting screen P21, there is displayed a decurl image of sheet Pa in the case of being ejected in sheet ejection tray 30*a* after straight one side face-up processing is applied on the sheet Pa as a decurl image.

Further, when "straight one side face-up mode" has not been selected, a flow runs to step ST12, and controller 15 develops decurl direction setting screen P22 of the "straight reversing face-down mode" (see FIG. 7), because "straight reversing face-down mode" should have been selected. On this decurl direction setting screen P22, there is displayed a decurl image of sheet Pa in the case of being ejected in sheet ejection tray 30*a* after straight reversing face-down processing is applied on the sheet Pa as a decurl image.

After that, the controller 15 judges whether convexness setting button B1 has been selected or not in step ST13 shown in FIG. 11. When the convexness setting button B1 is judged to have been selected, a flow runs to step ST14, and a convexness direction is set temporarily. After that, a flow runs to step ST19.

When the convexness setting button B1 has not been selected, a flow runs to step ST15, and controller 15 judges whether concaveness setting button B2 has been selected or not. When the concaveness setting button B2 is judged to have been selected, a flow runs to step ST16, and a concaveness direction is set temporarily. After that, a flow runs to step ST19.

When neither convexness setting button B1 nor concaveness setting button B2 has been selected, a flow runs to step ST17, and non-selection button B3 is judged whether it has been depressed or not by controller 15. When the non-selection button B3 has been depressed, a flow runs to step ST18, and there is set non-selection to conduct neither decurl processing in convexness direction nor decurl processing in concaveness direction.

An occasion where the non-selection button B3 is depressed is one wherein sheet Pa to be outputted to sheet ejection tray 30*a* is a flat surface that is free from irregularities such as curls and waviness. Meanwhile, when the non-selection button B3 is not depressed in step ST17, a flow returns to step ST13, and the aforesaid processing is caused to be repeated.

Then, in step ST19, controller 15 judges whether confirmation button B4 has been depressed or not. When the confirmation button B4 has been depressed, a flow runs to step ST20, and controller 15 confirms setting in the decurl direction. When convexness direction is set temporarily as a decurl direction in the aforesaid step ST14, convexness setting is confirmed as a decurl direction. When concaveness direction is set temporarily as a decurl direction in the step ST16, concaveness setting is confirmed as a decurl direction.

Further, when non-selection has been set concerning a decurl direction in step ST18, invalid setting of decurl processing is confirmed. These confirmed contents are caused to be notified from controller 15 to decurl unit 20. Owing to this, it is possible for a user to set easily a decurl direction for sheet Pa without considering post-processing conditions, while observing decurl direction setting screens P21, P22 and P23.

Figure 12:
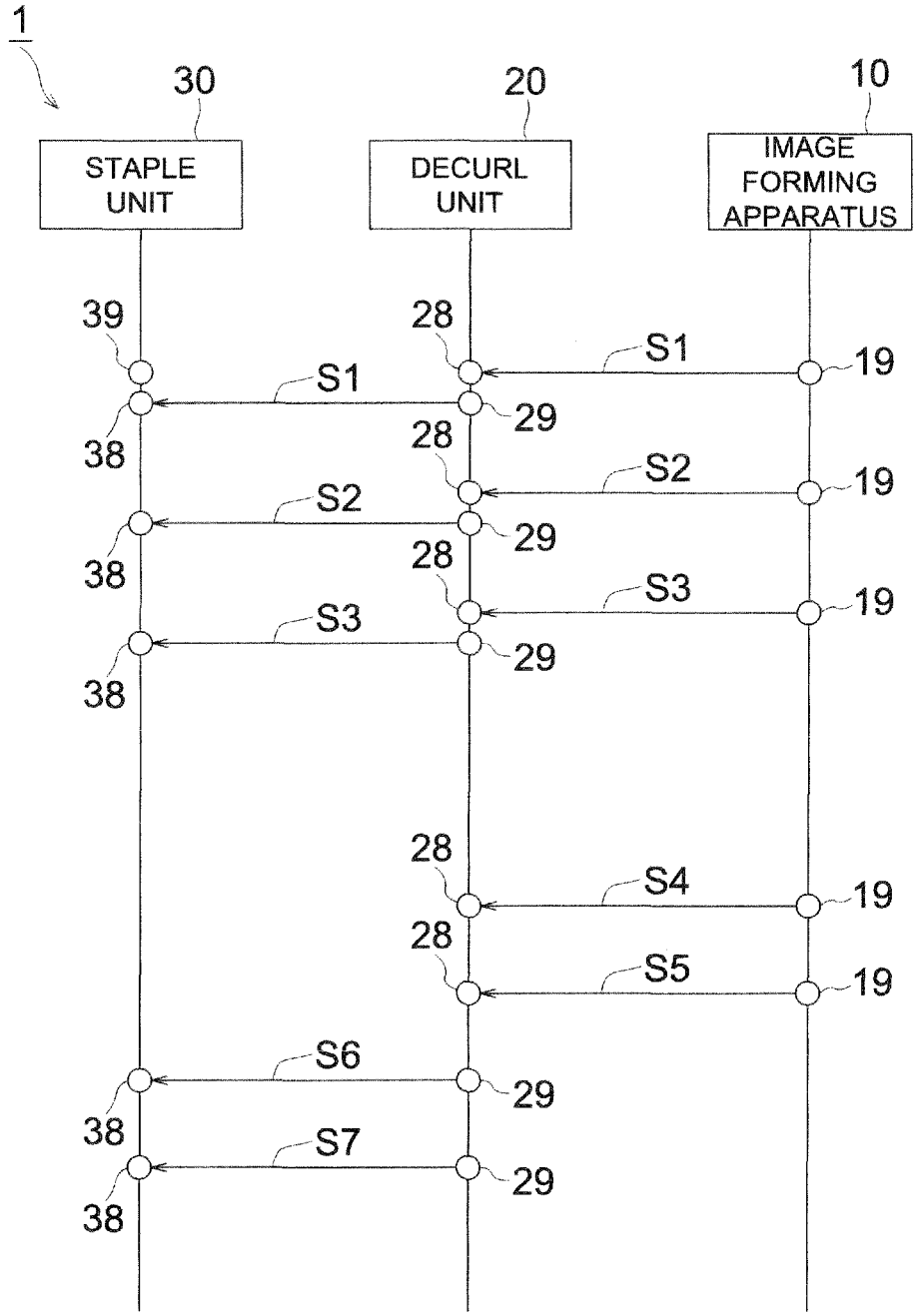
FIG. 12 is a sequence diagram (ladder diagram) showing an example of communication between image forming apparatus 10 in image forming system 1 and respective units.

Next, an example of communication in image forming system 1 will be explained. FIG. 12 is a sequence diagram (ladder diagram) showing an example of communication between an image forming apparatus in image forming system 1 and respective units.

In the example of communication sequence shown by FIG. 12, conditions of sheets to be outputted in image forming apparatus 10, post-processing conditions and decurl conditions are set. When output JOB is put, JOB information notifying signal S1 is transmitted from image forming apparatus 10 to decurl unit 20. The JOB information notifying signal S1 includes sheet information, post-processing information and decurl condition information. The JOB information notifying signal S1 constitutes down communication data D19 which will be outputted from serial communication section 19 of image forming apparatus 10 to serial communication section 28 decurl unit 20 (see FIG. 1).

When decurl unit 20 receives JOB information notifying signal S1, a condition is changed to the state of actions, and preparatory actions are started. Concurrently with this, the decurl unit 20 transmits JOB information notifying signal S1 to staple unit 30. The JOB information notifying signal S1 constitutes down communication data D29 which are outputted from serial communication section 29 for the rear step of decurl unit 20 to serial communication section 38 for the front step of staple unit 30 (see FIG. 1). When the staple unit 30 receives JOB information notifying signal S1, a condition is changed to the state of actions, and preparatory actions are started.

Next, image forming apparatus 10 transmits page information notifying signal S2 (first page) to decurl unit 20. The page information notifying signal S2 includes sheet information on the first page, post-processing information and decurl condition information. The page information notifying signal S2 constitutes down communication data D19 which are outputted from serial communication section 19 of image forming apparatus 10 to serial communication section 28 for the front step of the decurl unit 20 (see the same diagram).

With reception of the page information notifying signal S2 by the decurl unit 20, information for each sheet is caused to be held. Simultaneously with this, the decurl unit 20 transmits page information notifying signal S2 to staple unit 30. With reception of the page information notifying signal S2 by the staple unit 30, information for each sheet is caused to be held.

Further, image forming apparatus 10 transmits page information notifying signal S3 (second page) to decurl unit 20. The page information notifying signal S3 includes sheet information on the second page, post-processing information and decurl condition information. The page information notifying signal S3 constitutes down communication data D19 which are outputted from serial communication section 19 of image forming apparatus 10 to serial communication section 28 for the front step of the decurl unit 20 (see the same figure).

With reception of the page information notifying signal S3 by the decurl unit 20, information for each sheet is caused to be held. Simultaneously with this, the decurl unit 20 transmits page information notifying signal S3 to staple unit 30. With reception of the page information notifying signal S3 by the staple unit 30, information for each sheet is caused to be held.

After that, image forming apparatus 10 transmits sheet ejection notifying signal for the first page S4 to decurl unit 20. The sheet ejection notifying signal for the first page S4 constitutes down communication data D19 which are outputted from serial communication section 19 of image forming apparatus 10 to serial communication section 28 for the front step of the decurl unit 20 (see the same diagram). With reception of the sheet ejection notifying signal for the first page S4 by the decurl unit 20, control of each sheet Pa is started. For example, size control is carried out based on sheet information, and decurl control is carried out based on decurl condition information (see FIGS. 2A-4C).

Further, the image forming apparatus 10 transmits sheet ejection notifying signal for the second page S5 to decurl unit 20. The sheet ejection notifying signal for the second page S5 constitutes down communication data D19 which are outputted from serial communication section 19 of image forming apparatus 10 to serial communication section 28 for the front step of the decurl unit 20 (see the same figure). With reception of the sheet ejection notifying signal for the second page S5 by the decurl unit 20, control of each sheet Pa is carried out. For example, size control is carried out based on sheet information, and decurl control is carried out based on decurl condition information (see the same figure).

Then, the decurl unit 20 transmits sheet ejection information notifying signal S6 for page one to staple unit 30. With reception of the sheet ejection information notifying signal S6 for page one by the staple unit 30, control of each sheet is started. For example, size control is carried out based on sheet information, and staple control is carried out based on staple condition information (see FIGS. 2A-4C).

Further, the decurl unit 20 transmits sheet ejection information notifying signal S7 for page two to staple unit 30. With reception of the sheet ejection information notifying signal S7 for page two by the staple unit 30, control of each sheet is carried out. For example, size control is carried out based on sheet information, and staple control is carried out based on staple condition information (see the same diagram). Owing to this, it is possible to deal with JOB, while conducting communication processing with image forming apparatus 10, decurl unit 20 or with staple unit 30.

As stated above, in image forming system 1 representing an embodiment, decurl direction setting screen P21 for selecting the decurl direction given by decurl unit 20 and a decurl image showing the decurl direction of sheet Pa on sheet ejection tray 30*a* are indicated on the same selection screen of operation and display section 14. In addition, touch panel 48 is caused to be capable of operating so that decurl processing may be selected based on the decurl image of sheet Pa indicated in the same decurl setting screen 21.

Therefore, it is possible to confirm the decurl image after decurl processing for sheet Pa corresponding to the post-processing conditions, by an operation of selecting decurl processing. Owing to this, a decurl direction for correcting curls of sheet Pa can be set easily. Accordingly, erroneous setting of the decurl direction can be prevented, which is different from an occasion in the conventional method. Further, the state of finish of the image formation such as sheet Pa and booklet Pa' including curl correction processing can be confirmed easily, and high-quality image formation can be offered.

The present invention can be applied extremely favorably to printers, copying machines and multifunction peripherals for forming color images or monochrome images having decurl functions which correct curls on a sheet by replenishing an appropriate amount of moisture lost in the course of image forming.

What is claimed is:

1. A image forming system comprising:

an image forming section which forms an image on a sheet;

a decurl section which corrects a curl on the sheet on which the image has been formed;

a sheet ejection section on which the sheet is stacked after ejection;

a finishing section which conducts post processing on the sheet on which the image has been formed and ejects the sheet onto the sheet ejection section; and an operation and display section having a setting screen for setting a post-processing condition and a selection screen for selecting a decurl direction to be corrected by the decurl section, wherein the selection screen displays (i) a selection section that allows selection of the decurl direction given by the decurl section, and (ii) a decurl image that shows a decurl direction for the sheet to be outputted on the sheet ejection section after a decurl processing to be conducted by the decurl section, the decurl image representing a decurl state of the sheet in accordance with a set post-processing condition, and wherein the selection section and the decurl image are both displayed on a same selection screen.

2. The image forming system of claim 1, wherein the selection section has a first selection button which sets the decurl direction of the sheet to be convex, and a second selection button which sets the decurl direction of the sheet to be concave.

3. The image forming system of claim 2, wherein respective decurl images are displayed so as to respectively correspond to the first and second selection buttons.

4. The image forming system of claim 2, wherein the selection section has a non-selection button which causes both selections for setting convexness and setting concaveness of the sheet to be invalid.

5. The image forming system of claim 2, wherein the selection screen displays a confirmation button which allows determination of a selection by the selection section.

6. The image forming system of claim 1, further comprising a controller which controls the operation and display section, wherein the controller switches the display of the decurl image in the selection screen in accordance with a setting of the post-processing condition.

7. The image forming system of claim 1, wherein the post-processing condition includes at least one of stapling, center-stapling, Z-shaped folding, case binding, punching, face-up ejecting, and face-down ejecting processing.

8. An image forming apparatus comprising:

an image forming section which forms an image on a sheet;

a decurl section which corrects a curl on the sheet on which the image has been formed; and an operation and display section which displays a selection screen for selecting a decurl direction to be corrected by the decurl section;

wherein the selection screen displays (i) a selection section that allows selection of the decurl direction given by the decurl section, and (ii) a decurl image that shows a decurl direction for the sheet to be outputted on a sheet ejection section after a decurl processing to be conducted by the decurl section, the decurl image representing a decurl state of the sheet in accordance with a set post-processing condition, and wherein the selection section and the decurl image are both displayed on a same selection screen.

9. The image forming apparatus of claim 8, wherein the selection section has a first selection button which sets the decurl direction of the sheet to be convex, and a second selection button which sets the decurl direction of the sheet to be concave.

10. The image forming apparatus of claim 9, wherein respective decurl images are displayed so as to respectively correspond to the first and second selection buttons.

11. The image forming apparatus of claim 9, wherein the selection section has a non-selection button which causes both selections for setting convexness and setting concaveness of the sheet to be invalid.

12. The image forming apparatus of claim 9, wherein the selection screen displays a confirmation button which allows determination of a selection by the selection section.

13. The image forming apparatus of claim 8, further comprising a controller which controls the operation and display section, wherein the controller switches the display of the decurl image in the selection screen in accordance with the set post-processing condition.

14. The image forming apparatus of claim 13, wherein the post-processing condition includes at least one of stapling, center-stapling, Z-shaped folding, case binding, punching, face-up ejecting, and face-down ejecting processing.

* * * * *